US009314100B1

(12) United States Patent
Logan

(10) Patent No.: US 9,314,100 B1
(45) Date of Patent: Apr. 19, 2016

(54) SYSTEM AND METHOD FOR ENHANCED VIEWING OF AN EVENT

(71) Applicant: Gregory D. Logan, St. Louis, MO (US)

(72) Inventor: Gregory D. Logan, St. Louis, MO (US)

( * ) Notice: Subject to any disclaimer, the term of this patent is extended or adjusted under 35 U.S.C. 154(b) by 0 days.

(21) Appl. No.: 14/445,786

(22) Filed: Jul. 29, 2014

(51) Int. Cl.

| | |
|---|---|
| ***A47C 4/28*** | (2006.01) |
| ***A47C 1/14*** | (2006.01) |
| ***A47C 4/00*** | (2006.01) |
| ***A47C 3/40*** | (2006.01) |

(52) U.S. Cl.
CPC ... *A47C 1/14* (2013.01); *A47C 3/40* (2013.01); *A47C 4/00* (2013.01)

(58) Field of Classification Search
CPC ..... A47C 1/14; A47C 4/28; A47C 3/40
USPC ..... 297/45, 344.18, 31, 35, 37, 39
See application file for complete search history.

(56) References Cited

U.S. PATENT DOCUMENTS

| | | | | |
|---|---|---|---|---|
| 1,179,391 | A | 4/1916 | Bachman | |
| 1,973,226 | A | 9/1934 | Rose et al. | |
| 2,605,987 | A | 8/1952 | Marie | |
| 2,905,513 | A * | 9/1959 | Kane | 108/128 |
| 4,772,068 | A | 9/1988 | Gleckler et al. | |
| 5,364,163 | A * | 11/1994 | Hardison | 297/344.21 |
| 5,370,203 | A | 12/1994 | Kiska | |
| 5,494,333 | A | 2/1996 | Wilson | |
| 5,499,856 | A * | 3/1996 | Sorrell et al. | 297/344.18 X |
| 5,522,642 | A | 6/1996 | Herzog | |
| 6,012,546 | A | 1/2000 | Bee et al. | |
| 6,036,148 | A * | 3/2000 | Shank | 297/344.18 X |
| 6,056,353 | A | 5/2000 | Meara et al. | |
| 6,095,607 | A | 8/2000 | Wenzel | |
| 6,655,497 | B1 | 12/2003 | Weatherall | |
| 6,871,911 | B2 | 3/2005 | Alexander, Jr. | |
| 6,905,172 | B1 * | 6/2005 | Barnett | 297/344.18 X |
| 6,948,591 | B2 | 9/2005 | Scott et al. | |
| D512,576 | S | 12/2005 | Szyperski | |
| 7,246,779 | B2 | 7/2007 | Doyle | |
| 8,303,032 | B1 * | 11/2012 | Platta | 297/45 X |
| 8,465,090 | B1 * | 6/2013 | O'Connor | 297/45 |
| 8,517,462 | B2 * | 8/2013 | Birch | 297/4 |
| 8,960,784 | B1 * | 2/2015 | De Berry | 297/45 X |
| 2013/0026799 | A1 * | 1/2013 | Miller | 297/19 |

* cited by examiner

*Primary Examiner* — Rodney B White
(74) *Attorney, Agent, or Firm* — Grace J. Fishel

(57) ABSTRACT

A system and method for enhanced viewing of an event that provides a level, stable resting surface for viewing an event by adjusting at least one support member until a desired level surface is achieved, securely engaging a weighted member to the ground surface, elevating the seat above an obstructive object, and providing facilitated portability. The system includes a portable seat with a strap for carrying the seat on the back. The system also provides adjustable telescoping support assemblies that individually extend and retract to create a level surface for viewing the event. A release assembly biases the support assemblies towards extension, and locks them into a desired height with a spring-biased lock pin. A weighted member attaches to a mounting end of the telescoping support assembly for helping extend the support assembly. The weighted member pivots and includes a sharp end for digging into the ground.

13 Claims, 7 Drawing Sheets

SYSTEM AND METHOD FOR ENHANCED VIEWING OF AN EVENT

FIELD OF THE INVENTION

The present invention relates generally to a system and method for enhanced viewing of an event. More so, the system and method for enhanced viewing of an event provides a portable seat with legs that individually adjust to provide a level surface relative to a ground surface, elevation to bypass an obstructive object, mounting features to form a secure engagement with the ground surface, and facilitated portability for enhanced viewing of an event.

BACKGROUND OF THE INVENTION

Events are usually organized performances or ceremonies that display a particular activity. The event may include a sporting event, a play, a musical performance, a poetry recital, a ceremony, and the like. The actors in the event often prepare rigorously prior to the event. Events also provide entertainment for an audience.

Often, a large group of people who view the event form an audience. The audience is a group of people who view and/or participate in the vent. Some events invite overt audience participation and others allowing only modest clapping and criticism and reception. The audience may even participate in the event by encountering a work of art, literature as "readers", theatre, music as "listeners", video games as "players", or academics in any medium. In any case, the audience should have an unrestricted view to either passively or actively participate in the event.

Typically, events last for long durations, thereby requiring the audience to sit down for much of the event due to fatigue from standing or walking. By sitting or lying down while viewing the event, the audience may better appreciate the event. Various types of seating structures can accommodate the audience for this purpose. Bleachers or stands are raised, tiered rows of seats found at sports fields and other spectator events. Seats range from simple plank seats to more elaborate seats with backrests. Typically, the seating configuration provides a level, unhindered view of the event.

However, in outdoor events, structured seating may not be available, whereby the audience must bring its own seating. Festival seating typically refers to the form of general admission in which there is a large open area (generally outdoors) and all spectators must stand unless they are permitted to bring their own portable seating. Many music acts use festival seating because it allows the most enthusiastic fans to get near the stage and generate excitement for the rest of the crowd.

Seats are most often supported by four legs and have a back; however, a seat can have three legs or could have a different shape. For outdoor event venues, the seat is typically lightweight and portable to facilitate transport to the venue, and make suitable adjustments at the specific seating area. Often the seat brought by an audience member is not compatible with the terrain or elevation of the ground surface, and the event cannot be viewed properly. Excessive leaning forward or backward due to an uneven ground surface; bracing with the legs to adjust a seat; and craning of the neck to look above objects place stress on the joints associated with back pain. During long events, the constant stress from these unnatural physical adjustments may distract the audience member from enjoying the event.

SUMMARY OF THE INVENTION

This invention is directed to a system and method for enhanced viewing of an event that provides a level, stable resting surface for viewing an event by adjusting at least one support assembly until a desired level surface is achieved. The system includes a portable seat with support assemblies that individually adjust to provide a level surface with a ground surface, and weighted members that bias the support assemblies towards extension and are configured to securely engage the ground surface to provide an enhanced viewing of the event. In some embodiments, the system includes a portable seat with a strap for carrying the seat on the back. In this manner, the hands can remain free. The system also provides adjustable telescoping support assemblies that individually extend and retract to create a level surface for viewing the event. A release assembly biases the telescoping support assembly towards extension, and locks it into a desired height with a spring-biased lock pin. A weighted member attaches to a mounting end of the telescoping support assembly, whereby the weight and gravity work to extend the telescoping support assembly. The weighted member pivots and includes a sharp end for digging into the ground surface and providing additional stability.

A first aspect of the present invention provides system for enhanced viewing of an event comprising:

at least one support assembly, the at least one support assembly comprising a substantially square tubular shape, the at least one support assembly further comprising a first telescoping member and a second telescoping member, the second telescoping member being configured to slidably engage with the first telescoping member for extending and retracting, the second telescoping member being biased to extend from the first telescoping member, wherein each support assembly extends and retracts independently;

a release assembly, the release assembly being operatively biased to secure the first telescoping member and the second telescoping member together, the release assembly comprising a lever, the lever comprising a lever first end and a lever second end, the release assembly further comprising a first fastener attached to the lever first end and the at least one support assembly, the release assembly further comprising a spring member, the spring member being configured to support the lever second end, wherein downward pressure on the lever second end vertically displaces the first fastener to release the first telescoping member from the second telescoping member for extending and retracting the at least one support assembly; and a seat, the seat being disposed to position on the at least one support assembly, the seat being configured to provide a resting surface for viewing an event.

In a second aspect, each support assembly adjusts independently for providing a level surface on uneven terrain.

In another aspect, the square tubing of the support assembly helps restrict rotation of the first telescoping member and the second telescoping member together, thereby enhancing the performance of the release assembly.

In another aspect, the weighted member and gravity bias the at least one support assembly towards extension.

In another aspect, the weighted member pivots and includes a sharp end and a planar shape for helping secure the system to the ground surface.

In another aspect, the release assembly serves to release the second telescoping member from the first telescoping member for slidably engaging to extend and retract.

In another aspect, the spring member pivots so that a force applied to the lever second end vertically displaces the first fastener to release the first telescoping member from the second telescoping member, wherein the spring member pivots on a second fastener.

In yet another aspect, the first fastener comprises a locking pin.

In yet another aspect, shoulder straps are provided for carrying the system on the back.

In another aspect, in operation, the system and method for enhanced viewing of an event is utilized at an event venue where seating may not be available or easily accessible. The system may be transported to the event on shoulder straps. This is accomplished by passing both arms through either side of the straps, and securing the seat onto the back. Ideally, a desired area for watching the event is selected. The system is unfolded by separating the seat from a back section, and pivotally extending each support assembly. The ground surface is inspected for levelness and texture to determine the appropriate extension length for each support assembly. Those skilled in the art, in light of the present teachings, will recognize that the terrain at some outdoor events may be uneven or shifting, such as a sandy or muddy field.

In one embodiment, pressure is applied to the lever on the release assembly to release the first fastener, whereby the second telescoping member slidably engages the first telescoping member. In this manner, the second telescoping member extends. It is significant to note that each support assembly operates independently. Each support assembly is raised or lowered to a desired length for providing a level resting surface for the seat in relation to the ground surface. The support assembly may also be extended to a height that allows an audience member to view the event over taller objects. In this manner, the view of the event and the comfort while watching the event may be enhanced.

The second telescoping member terminates at a mounting end. The mounting end is positioned on a desired area of the ground surface. Those skilled in the art, in light of the present teachings, will recognize that positioning the at least one support assembly requires a balance between the optimal area for having a clear view of the event, and an acceptable ground surface for comfortable, unhindered viewing. The mounting end includes a weighted member, which, along with gravity, acts to bias the second telescoping member towards extension when the release assembly is actuated. The weighted member pivotally attaches to the mounting end, whereby a sharp end can be tilted to penetrate the ground surface. In this manner, the at least one support assembly forms a firm grip on sloped surfaces and shifting soils.

One benefit of the system and method for enhanced viewing of an event is that it allows for more seating options on a variety of terrains at outdoor event venues.

Another benefit is that the system and method for enhanced viewing of an event provides a lightweight and portable outdoor seat that can easily be carried with shoulder straps.

In yet another benefit, the view of the event is enhanced because of the level seating on sloped surfaces, firm engagement with the ground surface, and adjustable height for viewing over obstacles.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
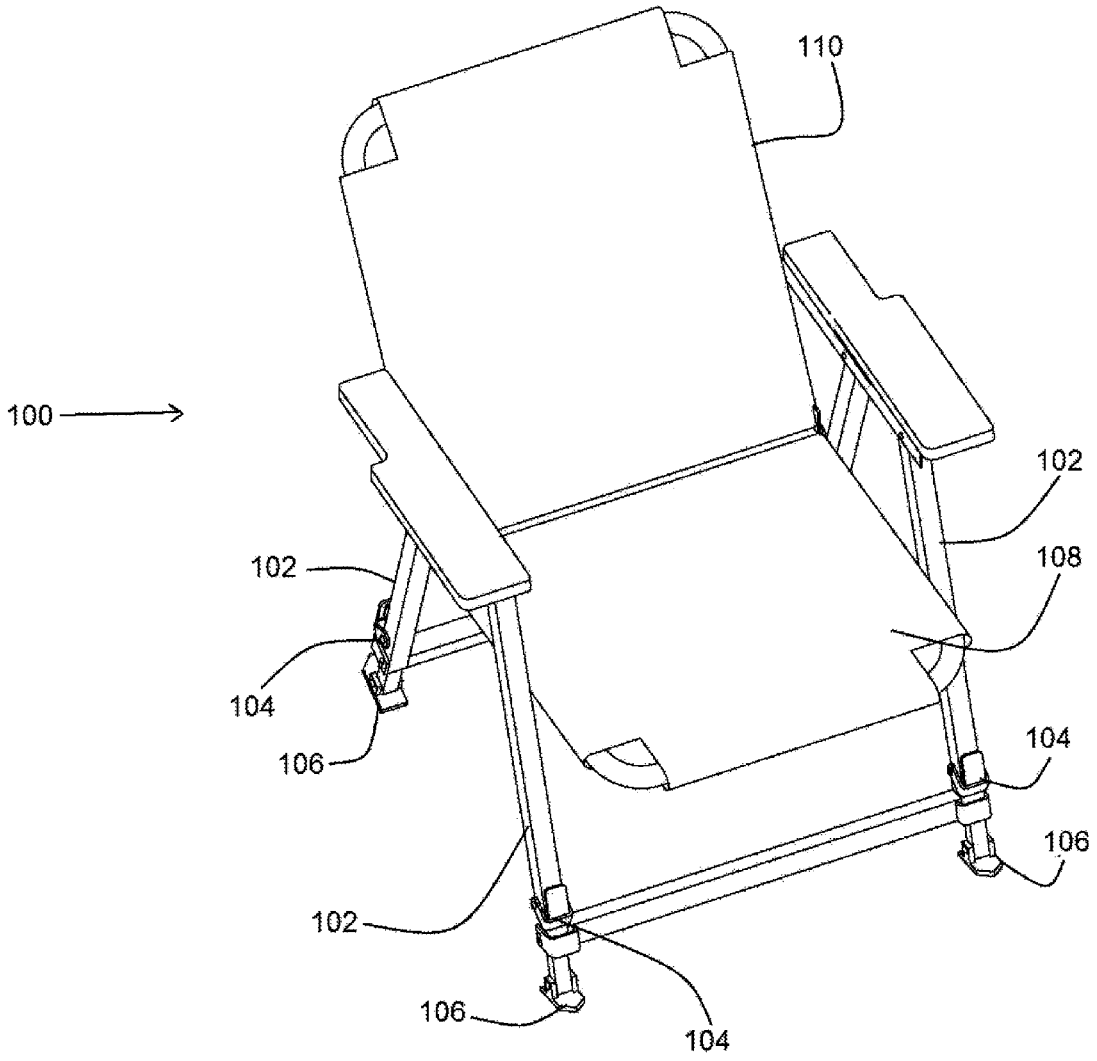
FIG. 1 presents a detailed perspective view of a system for enhanced viewing of an event, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A system for enhanced viewing of an event 100 is described in FIGS. 1 through 11. The system for enhanced viewing of an event 100 is an assembly comprising: at least one support assembly 102 comprising a substantially square tubular shape. The at least one support assembly 102 comprising a first telescoping member 406 (FIGS. 4A and 4B) and a second telescoping member 408 (FIGS. 4A and 4B). The second telescoping member 408 slidably engages with the first telescoping member 406 for extending and retracting. The second telescoping member 408 is biased to extend from the first telescoping member 406, wherein each support assembly 102 extends and retracts independently. A release assembly 104 (FIG. 1) being operatively biased to secure the first telescoping member 406 and the second telescoping member 408 together. The release assembly 104 comprises a lever 202 (FIGS. 2-6). The lever 202 comprises a lever first end 204 and a lever second end 206. The release assembly 104 further comprises a first fastener 402 for extending from the lever first end 204 and the at least one support assembly 102. The release assembly 104 further comprises a spring member 208. The spring member 208 is configured to support the lever second end 206, wherein downward pressure on the lever second end 206 vertically displaces the first fastener 402 to release the first telescoping member 406 from the second telescoping member 408 for extending and retracting the at least one support assembly 102. A second fastener 404 secures the spring member 208 to the at least one support assembly 102. A seat 108 disposed to position on the at least one support assembly 102. The seat 108 is configured to provide a resting surface for viewing an event. The seat 108 may include a rear support 110 for supporting a back. The seat may further include a seat handle 702 such as shoulder straps for carrying the system for enhanced viewing of an event 100.

Figure 2:
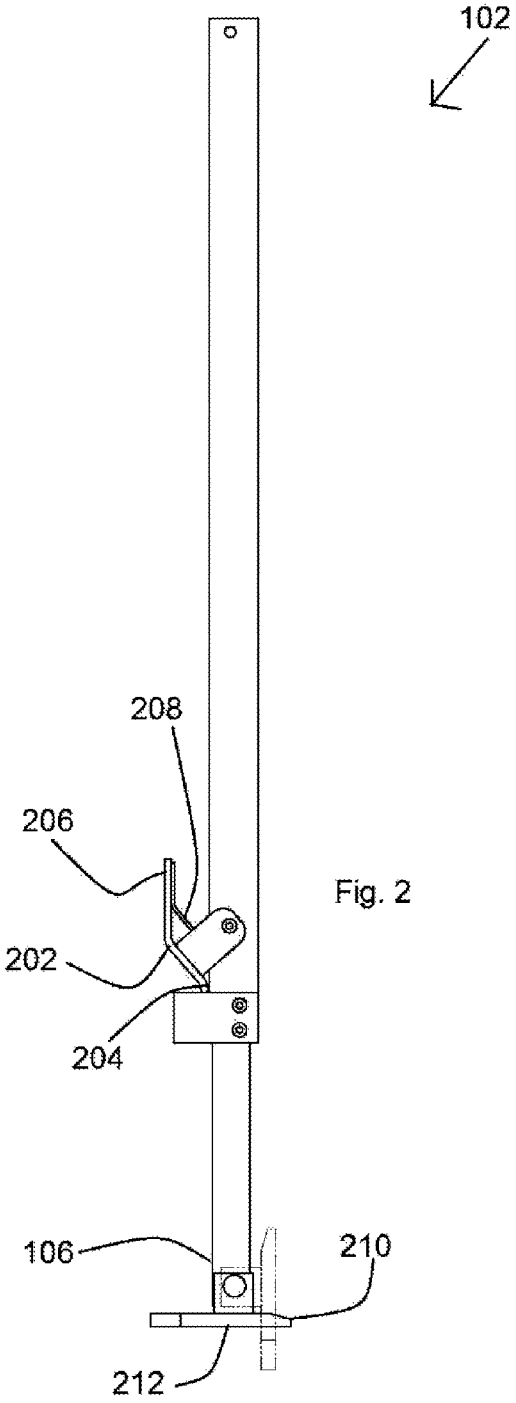
FIG. 2 presents a side elevation of a support assembly with a weighted member pivoting on a mounting end, in accordance with an embodiment of the present invention.
Figure 3:
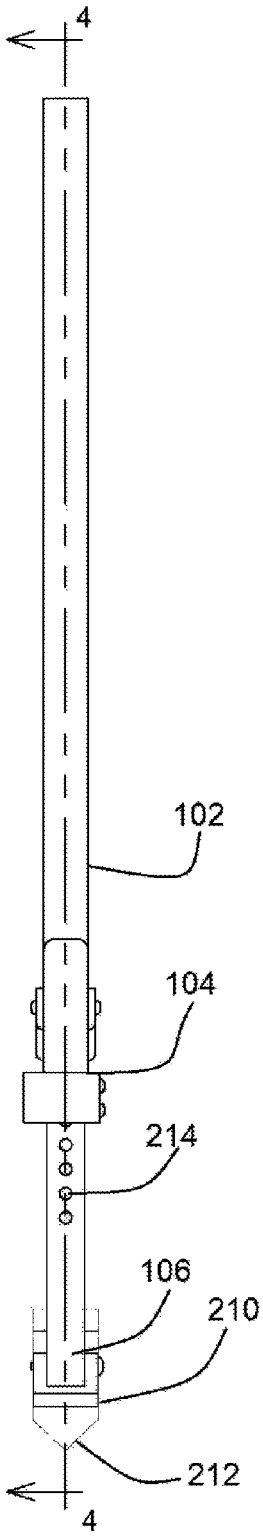
FIG. 3 presents a front elevation of the support assembly, in accordance with an embodiment of the present invention.
Figure 4A:
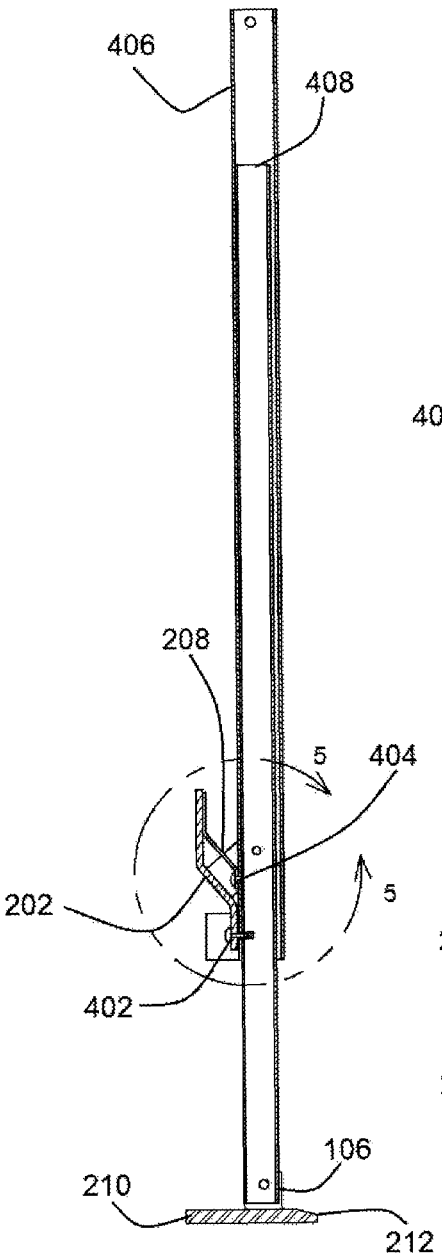
FIGS. 4A and 4B are taken along the plane of 4-4 in FIG. 3 and present sectioned views of a support assembly with the release assembly in a lock position and a release position, in accordance with an embodiment of the present invention.
Figure 5:
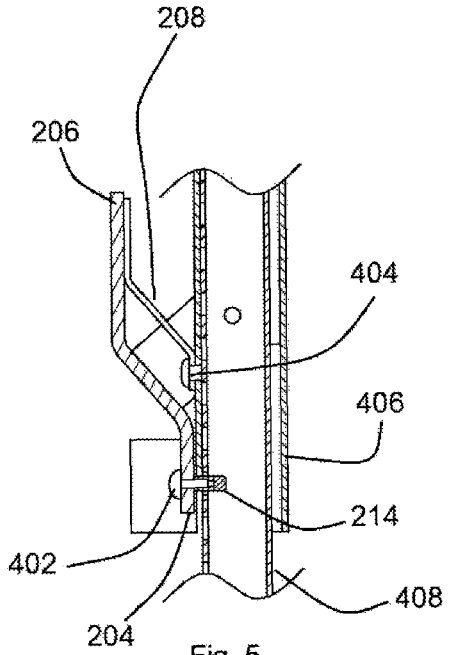
FIG. 5 presents a close up view of a release assembly on an enlarged scale and taken along line 5-5 in FIG. 4A locking the first telescoping member to the second telescoping member with a first fastener, in accordance with an embodiment of the present invention.
Figure 6:
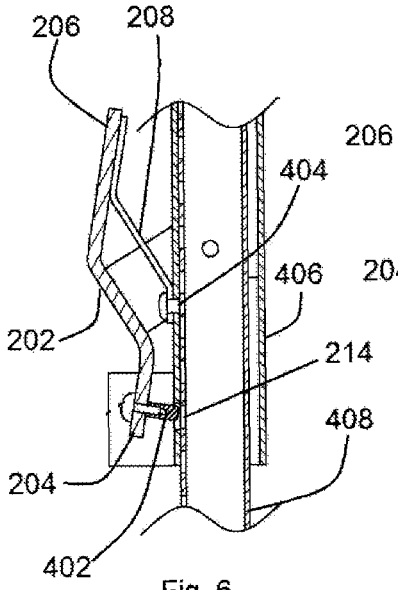
FIG. 6 presents a close up view of a release assembly on an enlarged scale and taken along line 6-6 in FIG. 4B releasing the first telescoping member from the second telescoping member, in accordance with an embodiment of the present invention.
Figure 4B:
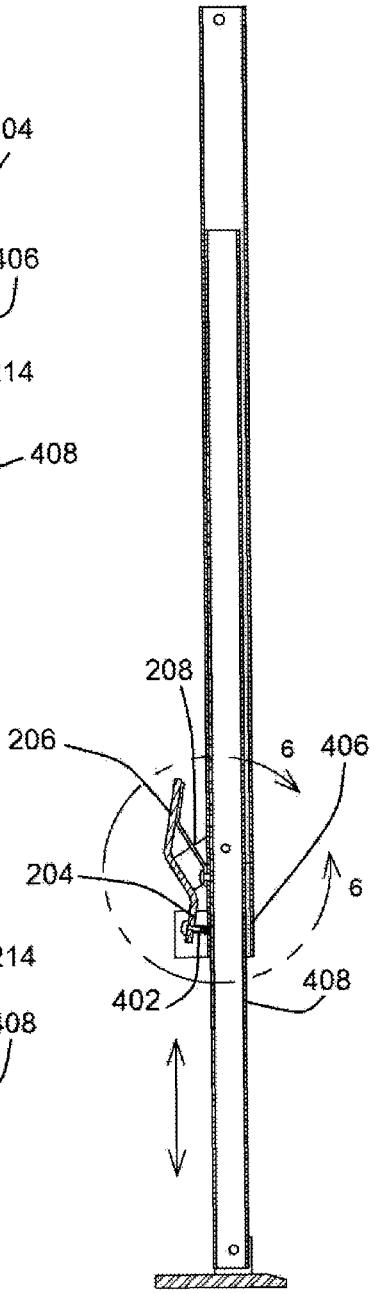
Figure 8:
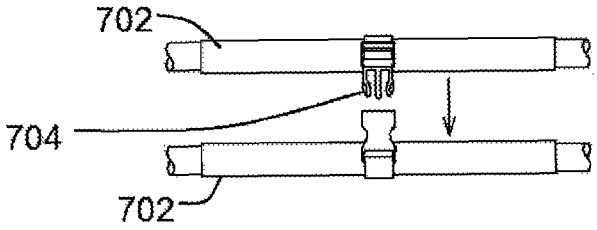
FIG. 8 presents a top view of a locking assembly for the folded seat, in accordance with an embodiment of the present invention.
Figure 7:
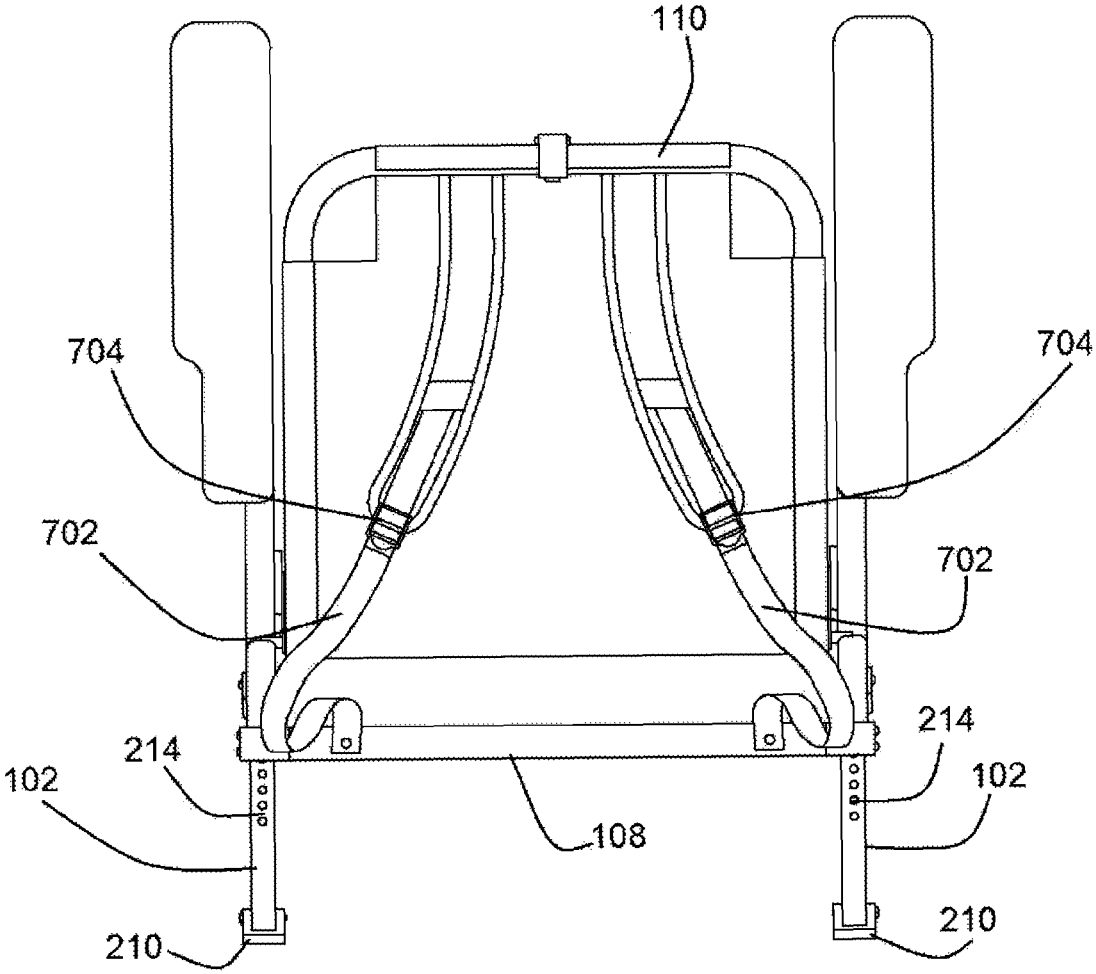
FIG. 7 presents a back elevation of a folded seat and a seat handle, in accordance with an embodiment of the present invention.

FIGS. 2 and 3 together with FIGS. 4A and 4B illustrate the at least one support assembly 102. The at least one support assembly 102 is fabricated having a first telescoping member 406 and a second telescoping member 408 slidably assembled together, wherein a second telescoping member outer surface of second telescoping member 408 are sized and shaped to slideably engage with a first telescoping member inner surface of first telescoping member 406. The first telescoping member 406 and second telescoping member 408 move respective to one another in association with a telescoping motion. In some embodiments, the first telescoping member 406 and the second telescoping member 408 comprise square tubing for restricting rotation. Suitable materials for the at least one support assembly 102 include, without limitation, aluminum, high density polymers, fiberglass, wood, and alloys.

In some embodiments, the second telescoping member 408 terminates at a mounting end 106 for engaging a ground surface 1000. The mounting end 106 is positioned on a desired area of the ground surface 1000 for viewing the event. Those skilled in the art, in light of the present teachings, will recognize that positioning the mounting end 106 requires a balance between the optimal area to view of the event unhindered, and a ground surface 1000 having a level, stable terrain to support unhindered viewing. In some embodiments, the mounting end 106 includes a weighted member 210, which, along with gravity, acts to bias the second telescoping member 408 towards extension when the release assembly 104 is actuated. The weighted member 210 pivotally attaches to the mounting end 106, tilting in a substantially vertical alignment to the second telescoping member 408. In some embodiments, the weighted member 210 comprises a planar shape for maximizing contact with the ground surface 1000. In yet another embodiment, the weighted member 210 includes a sharp end 212 for penetrating the ground surface 1000. The weighted member 210 may be tilted to a desired angle to stabilize the system for enhanced viewing of an event 100 against slippage. In this manner, the at least one support assembly 102 forms a firm grip on sloped surfaces and shifting soils. In one alternative embodiment, the weighted member 210 may include a magnet for securely attaching to metal bleachers. In yet another alternative embodiment, a mounting surface of the weighted member 210 comprises a plurality of ridges to provide additional traction on a sloped surface. In yet another alternative embodiment, each support assembly 102 angles slightly outwardly beyond a parallel alignment to form a wider base, whereby heavier loads can be supported.

In some embodiments, a release assembly 104 can be included to secure the first telescoping member 406 and second telescoping member 408. In this manner, when a desired length for each support assembly 102 has been achieved, each support assembly 102 is positioned to create a level surface for enhanced viewing of the event. In one embodiment of the present invention, the release assembly 104 may function to release the first telescoping member 406 and the second telescoping member 408 for slidable engagement. The release assembly 104 comprises a substantially Z-shaped lever 202 that rests on a spring member 208. Pressure on a lever first end 204 creates a pivoting motion that extends and retracts a first fastener 402 from a plurality of positioning holes. The first fastener 402 may include, without limitation, a lock pin, a bolt, and a screw. The disposition of the first fastener 402 in the plurality of positioning holes serves to lock and release the second telescoping member 408 and the first telescoping member 406. In one embodiment, the lever 202 attaches to the support assembly 102 from a lever first end 204 and rests on a spring member 208 from a lever second end 206. The spring member 208 may include an arc-shaped length of spring steel of rectangular cross-section, including, without limitation, a leaf spring, an elliptic spring, and a damper. A downward pressure on the lever second end 206 vertically displaces a first fastener 402 to release the first telescoping member 406 from the second telescoping member 408 for extending and retracting the at least one support assembly 102. The release assembly 104 comprises a lightweight material, such as aluminum or polymers for reducing weight and facilitating transport of the system for enhanced viewing of an event. It is understood that the release assembly 104 can be any locking interface, which applies any locking force to the two telescoping members. Those skilled in the art can appreciate the lever 202 can be rigidly fixed to the spring member 208 in a less adaptive embodiment.

Figure 9:
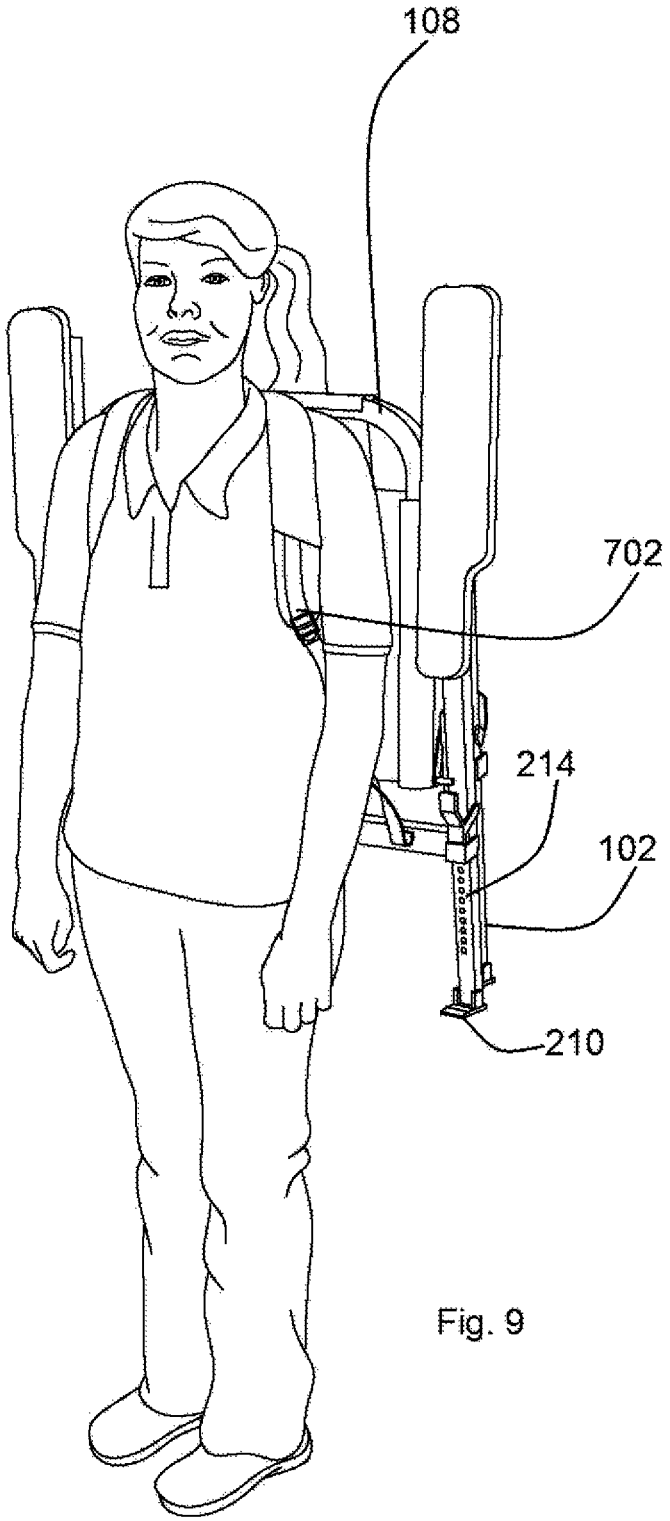
FIG. 9 presents a perspective view of an audience member carrying a system for enhanced viewing of an event, in accordance with an embodiment of the present invention.
Figure 10:
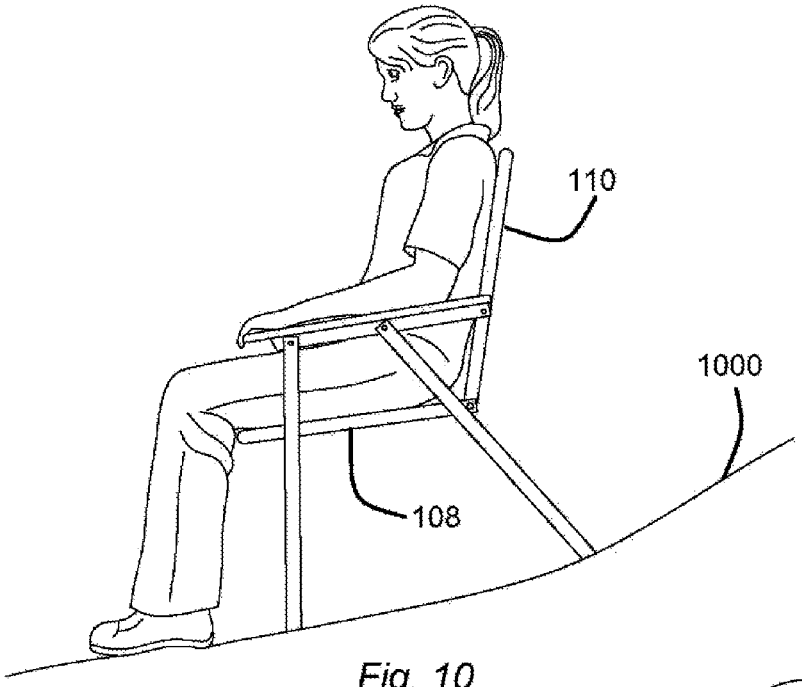
Fig. 10 (Prior Art)
FIG. 10 presents a side elevation of an audience member sitting on an inclined seat on an uneven slope, in accordance with the prior art.
Figure 11:
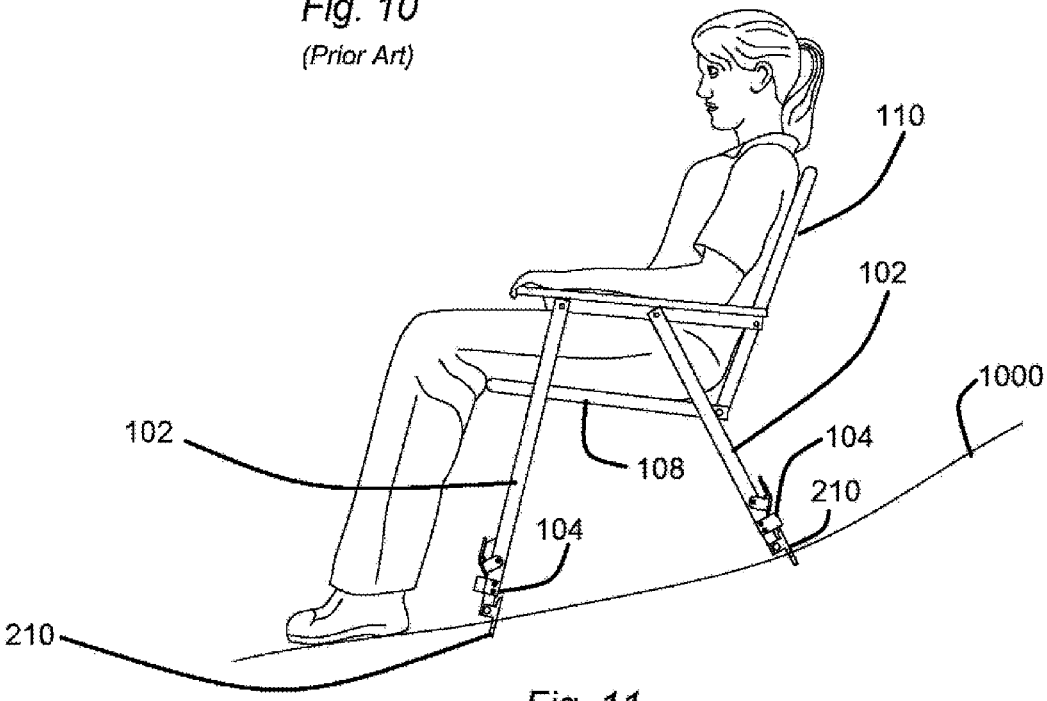
FIG. 11 presents a side elevation of an audience member sitting on a level seat on an uneven slope, in accordance with an embodiment of the present invention.

In one embodiment of the present invention, a seat 108 positions on the at least one support assembly 102 for providing a surface for resting (FIG. 1). The seat 108 may be fabricated from a lightweight, waterproof material having sufficient durability for outdoor events. The seat material may include, without limitation, vinyl mesh, webbing, vinyl coated polyester fabric, and solution-dyed acrylic fabric. In some embodiments, the system for enhanced viewing of an event 100 includes a portable seat 108 with a seat handle 702 such as shoulder straps. A buckle 704 may be provided for adjusting the length of the straps. In some embodiments, the seat 108 may include a rear support 110 configured to be operable for a back to rest against. In this manner, the seat 108 forms a substantially perpendicular angle with the rear support 110. In one embodiment, the seat 108 folds for facilitated carrying. While the seat 108 is in a folded position, the seat 108 collapses onto the rear support 110. Additionally, each support assembly 102 folds into the seat 108 such that the seat 108 forms a substantially planar shape. The seat handle 702 may then be adorned across the back for carrying the seat 108 (FIG. 9).

The system for enhanced viewing of an event 100 is designed to provide a level, stable resting surface for viewing an event by adjusting at least one support assembly 102 until a desired level surface is achieved, securely engaging a weighted member 210 to the ground surface 1000, elevating the seat above an obstructive object, and providing facilitated portability. Details of the installation of the exemplary system for enhanced viewing of an event 100 are illustrated in FIGS. 9 through 12. In operation, the system for enhanced viewing of an event 100 is utilized at an event venue where seating may not be available or easily accessible. The system for enhanced viewing of an event 100 is portable. For example, without limitation, a seat handle 702, such as a strap, extends across opposite ends of the seat when in a folded position. The seat handle 702 is configured to be operable to attach to a back. A seat handle locking assembly 704 (FIG. 8) holds the seat and back together in folded position. In use, a user passes both arms through either side of the seat handle 702 thus securing the seat onto the user's back. Ideally, a desired area for watching the event is selected. After unlatching the locking assembly 704, the system 100 is unfolded by separating the seat 108 from a back section, and pivotally extending each support assembly 102. The ground surface 1000 is inspected for levelness and texture to determine the appropriate extension length for each support assembly 102. Those skilled in the art, in light of the present teachings, will recognize that outdoor events may not include structured seating. The audience must provide its own seating, and the terrain may be uneven or shifting, such as a sandy or muddy field.

FIGS. 4A, 4B, 5, and 6 illustrate how a force is applied to the lever on the release assembly 104 to release the first fastener 402, whereby the second telescoping member 408 slidably engages the first telescoping member 406. In this manner, the second telescoping member 408 extends. It is significant to note that each support assembly 102 operates independently. Each support assembly 102 is raised or lowered to a desired length for providing a level resting surface for the seat in relation to the ground surface 1000. The support assembly 102 may also be extended to a height that allows an audience member to view the event over taller objects. In this manner, the view of the event and the comfort while watching the event may be enhanced.

The second telescoping member 408 terminates at a mounting end 106. The mounting end 106 is positioned on a desired area of the ground surface 1000. Those skilled in the art, in light of the present teachings, will recognize that positioning the at least one support assembly 102 requires a balance between the optimal area for having a clear view of the event, and an acceptable ground surface 1000 for comfortable, unhindered viewing. The mounting end 106 includes a weighted member 210, which, along with gravity, acts to bias the second telescoping member 408 towards extension when the release assembly 104 is actuated. The weighted member 210 pivotally attaches to the mounting end 106, whereby a sharp end 212 can be tilted to penetrate the ground surface 1000. In this manner, the at least one support assembly 102 forms a firm grip on sloped surfaces and shifting soils.

When installed, the downward force applied on the lever first end 204 necessary to release the first fastener 402 from the plurality of positioning holes is transferred to a compressive force applied to the spring member 208. This provides an extremely strong and reliable configuration for holding the telescoping members in a desired configuration while supporting heavy weights.

Figure 12:
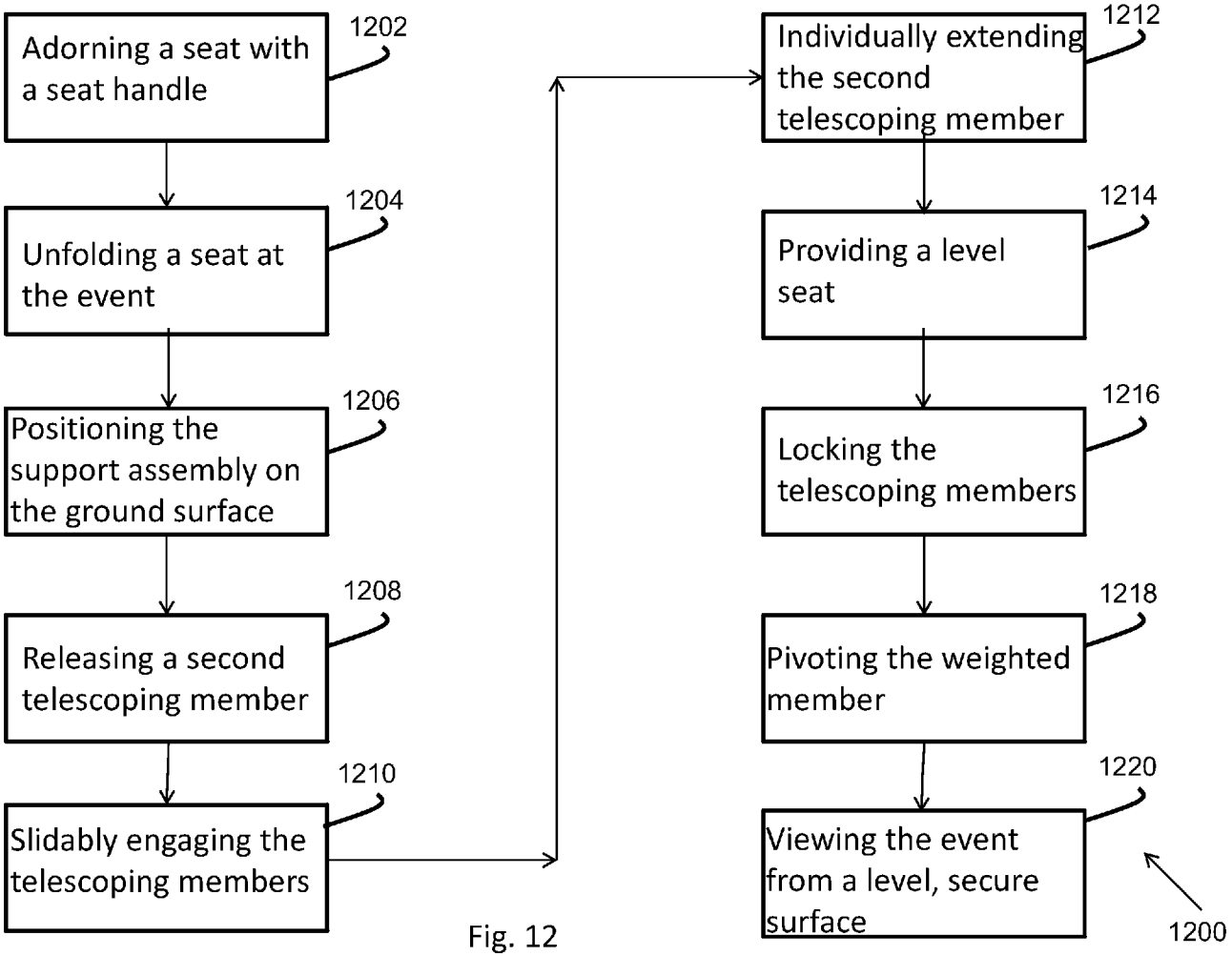
FIG. 12 presents a flowchart diagram of a method for enhanced viewing of an event, in accordance with an embodiment of the present invention.

In one embodiment of the present invention, a method for enhanced viewing of an event 1200 is presented in FIG. 12 as a flowchart diagram. The method 1200 comprises an initial Step 1202 of adorning a seat handle 702 across the back for carrying a system for enhanced viewing of an event. A Step 1204 includes unfolding the seat 108 at the event. The at least one support assembly 102 is folded outwardly, and the seat 108 and the rear support 110 are separated into a substantially perpendicular angle. A Step 1206 includes positioning at least one support assembly 102 on a desired area of the ground surface 1000. A Step 1208 comprises releasing a second telescoping member 408 with a release assembly 104. A force is applied to a lever first end 204, which compresses a spring member 208 to pivotally retract a first fastener 402 from a plurality of positioning holes 214 in the at least one support assembly 102. A Step 1210 includes slidably engaging the second telescoping member 408 with a first telescoping member 406. A next Step 1212 includes extending the second telescoping member 408 of each support assembly 102 to a desired height, with the help of a weighted member 210 and gravity. The weight biases towards the extension. A Step 1214 comprises providing a level seat 108 for enhanced viewing of the event. A Step 1216 includes locking the second telescoping member 408 to the first telescoping member 406 with the release assembly 104. A Step 1218 comprises pivoting the weighted member 210 to orient a sharp end 212 towards the ground surface 1000 for enhanced stability. A Step 1220 includes viewing the event from a level, secure seat 108.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A system for enhanced viewing of an event, the system comprising:

at least one support assembly, the at least one support assembly comprising a substantially square tubular shape, the at least one support assembly further comprising a first telescoping member and a second telescoping member, the second telescoping member being configured to slidably engage with the first telescoping member for extending and retracting, the second telescoping member being biased to extend from the first telescoping member, wherein the at least one support assembly extends and retracts independently;

a release assembly, the release assembly being operatively biased to secure the first telescoping member and the second telescoping member together, the release assembly comprising a lever, the lever comprising a substantially Z-shape, the lever comprising a lever first end and a lever second end, the release assembly further comprising a first fastener for at least partially passing through an aperture in the first telescoping member and latching into one of a plurality of vertically aligned apertures in the second telescoping member, the release assembly further comprising a Z-shaped spring member, the spring member being configured to support the lever second end, wherein downward pressure on the lever second end vertically displaces the first fastener to release the first telescoping member from the second telescoping member for extending and retracting the at least one support assembly; and a seat, the seat being disposed to position on the at least one support assembly, the seat being configured to provide a resting surface for viewing the event.

2. The system of claim 1, wherein the second telescoping member comprises a mounting end for engaging a ground surface.

3. The system of claim 2, wherein the mounting end comprises a weighted member, the weighted member and gravity biasing the second telescoping member to extend from the first support assembly.

4. The system of claim 3, wherein the weighted member comprises a planar shape for maximizing engagement with the ground surface.

5. The system of claim 4, wherein the weighted member comprises a sharp end for at least partially penetrating the ground surface.

6. The system of claim 5, wherein the weighted member is pivotally connected to the mounting end.

7. The system of claim 6, wherein pivoting the weighted member vertically positions the sharp end to penetrate the ground surface.

8. The system of claim 1, wherein the release assembly comprises a second fastener for joining the spring member to the at least one support assembly.

9. The system of claim 1, wherein the seat comprises a seat handle configured to be operable for a back to carry the system.

10. The system of claim 9, wherein a locking assembly is provided for securing the seat and a rear support together in folded position.

11. The system of claim 10, wherein the rear support is positioned in a substantially perpendicular orientation to the seat.

12. The system of claim 11, wherein the seat is operable to form a folded position for facilitated carrying, wherein the rear support pivotally joins with the seat, and the at least one support assembly pivotally folds inwardly towards the seat.

13. A system for enhanced viewing of an event, the system consisting of:

four support assemblies, the four support assemblies comprising a square tubular shape, the four support assemblies further comprising a first telescoping member and a second telescoping member, the second telescoping member being configured to slidably engage with the first telescoping member for extending and retracting, the second telescoping member being biased to extend from the first telescoping member, wherein each support assembly extends and retracts independently, the second telescoping member further comprising a mounting end for engaging a ground surface, the mounting end comprising a weighted member, the weighed member comprising a sharp end;

a release assembly, the release assembly being operatively biased to secure the first telescoping member and the second telescoping member together, the release assembly comprising a lever, the lever comprising a substantially Z-shape, the lever comprising a lever first end and a lever second end, the release assembly further comprising a first fastener for at least partially passing through an aperture in the first telescoping member and latching into one of a plurality of vertically aligned apertures in the second telescoping member, the release assembly further comprising a Z-shaped spring member, the spring member being configured to support the lever second end, wherein downward pressure on the lever second end vertically displaces the first fastener to release the first telescoping member from the second telescoping member for extending and retracting the four support assemblies; and a seat, the seat being disposed to position on the four support assemblies, the seat comprising a rear support configured to be operable to support a back, the seat being configured to provide a resting surface for viewing an outdoor event.

* * * * *